US012687022B1

(12) United States Patent
Warford

(10) Patent No.: US 12,687,022 B1
(45) Date of Patent: Jul. 21, 2026

(54) ADJUSTABLE WHEELCHAIR RAMP HAVING FEWER PARTS

(71) Applicant: Lawrence Eugene Warford, Bonney Lake, WA (US)

(72) Inventor: Lawrence Eugene Warford, Bonney Lake, WA (US)

( * ) Notice: Subject to any disclaimer, the term of this patent is extended or adjusted under 35 U.S.C. 154(b) by 657 days.

(21) Appl. No.: 18/199,909

(22) Filed: May 19, 2023

(51) Int. Cl.
*E04F 11/00* (2006.01)

(52) U.S. Cl.
CPC ..... *E04F 11/002* (2013.01); *E04F 2011/005* (2013.01); *E04F 2011/007* (2013.01)

(58) Field of Classification Search
None
See application file for complete search history.

(56) References Cited

U.S. PATENT DOCUMENTS 4,468,901 A * 9/1984 Henderson ..... E04F 11/025 52/79.6
7,240,388 B2 * 7/2007 Warford ..... E04F 11/002 14/69.5
7,607,186 B1 * 10/2009 Mitchell ..... E04F 11/002 52/174
8,844,083 B2 * 9/2014 McGivern ..... E04F 11/002 14/69.5
8,959,693 B2 * 2/2015 Pohlman ..... E04F 11/002 193/38
2003/0155567 A1 * 8/2003 Sax ..... E04H 17/124 256/37
2004/0133998 A1 * 7/2004 Sloniker ..... B65G 69/30 14/69.5
2019/0119922 A1 * 4/2019 Winter ..... E04F 11/002

FOREIGN PATENT DOCUMENTS

CA 2921445 C * 1/2018 ..... E04F 11/002
EP 3647511 A1 * 5/2020 ..... E04F 11/002

* cited by examiner

*Primary Examiner* — Christopher J Sebesta
*Assistant Examiner* — Katherine J Chu
(74) *Attorney, Agent, or Firm* — Joseph Z. Ellsworth

(57) ABSTRACT

A modular portable wheelchair ramp comprising a plurality of mechanically interconnected modular ramp sections and railing sections. The ramp sections are essentially one piece, and the railing sections are essentially one piece that are easily assembled on site. The sections slide together and are held in place by an adjustment bolt and a bolt through an outer post aperture.

17 Claims, 6 Drawing Sheets

ADJUSTABLE WHEELCHAIR RAMP HAVING FEWER PARTS

This application is a continuation in part (CIP) application claiming priority under 35 U.S.C. § 120 to U.S. patent application Ser. No. 18/199,909, entitled ADJUSTABLE WHEELCHAIR RAMP HAVING FEWER PARTS, filed May 19, 2023.

BACKGROUND

Field of the Invention

This invention relates to ramps and more specifically to a lightweight and portable wheelchair ramp where each section is a single part.

Description of Related Art

It is known to have wheelchair ramps. The American Disability Act (ADA) requires that wheelchair ramps be placed in all public entry ways, thus insuring entrance to all. Although portable wheelchair ramps, even modular ramps, have long been used in various types of construction, the standards for these ramps have become more stringent, precluding the use of many prior wheelchair ramps. To satisfy these requirements many companies have designed complex ramps with many parts that must be assembled onsite. These difficult to assemble ramps pass much of the assembly cost and risk to the customer.

SUMMARY

It is an objective of some examples to address the problems in the prior art and provide a ramp suitable for wheelchair use that is modular, adjustable in height, lightweight, easy to assemble and disassemble, and still comply with the ADA with a high safety factor. These objectives are achieved in a portable wheelchair ramp comprising a plurality of mechanically interconnected modular ramp sections. Ramp sections interconnect end to end with a male J-hook interlocking with a female J-hook on adjacent ramp ends. A bar below the hook extends into the keyway to further engage adjacent ramp ends, preventing relative vertical movement between the adjacent ramps.

A modular ramp that is easier to assemble may include a plurality of ramp sections connected end to end, the ramp sections each having a first longitudinal sidewall running along its length, a railing connector coupled to the first longitudinal sidewall, having an attachment channel cut into an outside flange. The modular ramp also has a railing section having an inner post with an adjustable leg and an adjustment bolt and an outer post having an outer newel channel. The ramp section is connected to the railing section at the railing connector.

A method of assembling a modular ramp includes positioning a ramp section at a desired height and orientation and inserting a male J-hook connector of an adjacent ramp section into the female J-hook connector of the ramp section. Then, sliding an inner post into a railing connector and positioning the inner post such that the adjustment bolt slides into the attachment channel in the railing connector. Finally, sliding the outer post over the adjacent railing section's inner post.

DETAILED DESCRIPTION

Figure 2:
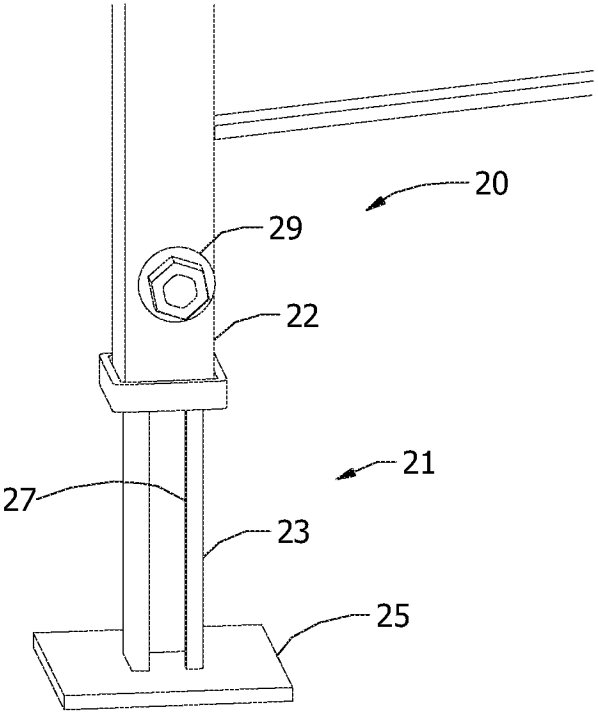
FIG. 2 is a close-up perspective view of an adjustable leg of a railing section.
Figure 1:
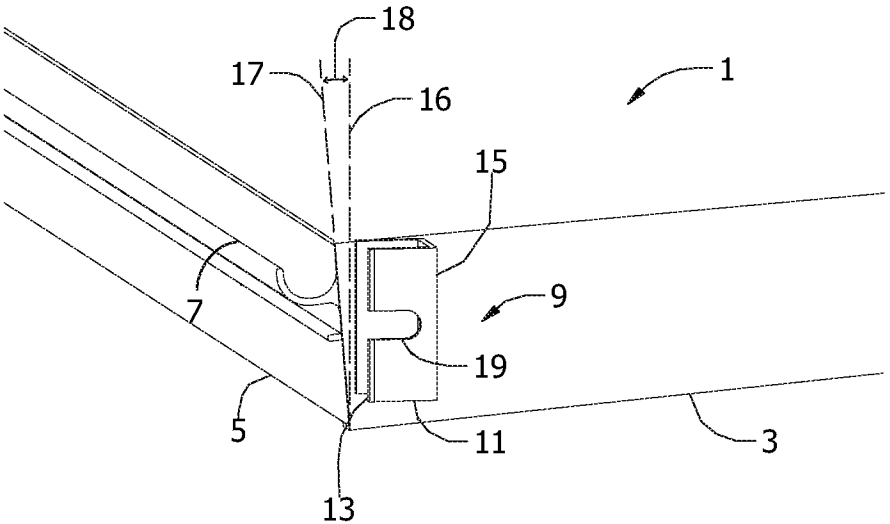
FIG. 1 is a close-up perspective view of a corner of a ramp section.

A modular and simple to assemble wheelchair ramp is constructed from many ramp sections 1 connected end to end. The ramp section 1 has a first longitudinal sidewall 3 running along its length and a first transverse sidewall 5 running along its width. The first transverse sidewall has a male J-hook 7 that connects the ramp sections 1 to each other. A railing connector 9 is coupled to the first longitudinal sidewall 3 and enables quick connection of a railing section to the ramp section. The railing connector 9 is made from a square C-channel 11 having an open end 13 facing away from the ramp section 1 and closed end 15 facing toward the length of the ramp section 1. The railing connectors must be vertical and therefore have a railing section orientation 16. The ramp sections are used to ramp up into a building and are therefore not horizontal but have a ramp surface normal 17. The angle between the railing section orientation 16 and the ramp surface normal 17 is the ramp angle 18. Therefore, knowing the ramp angle required by the engineering drawings or required by the ADA will set the railing section orientation 16. The railing connector 9 has an attachment channel 19 cut into one side. This attachment channel 19 is preferably horizontal but may be angled up to allow gravity to lock the railing section in place against the closed end 15.

Railing section 20 has an adjustable leg 21 on one end. The adjustable leg 21 has a fixed portion 22 and an inner leg 23 that slidably fits within fixed portion 22. A foot 25 is affixed to the end of the inner leg 23 and interfaces with the ground or a pier block. A channel 27 allows the inner leg 23 to slide past adjustment bolt 29 that clamps the assembly in place. The adjustment bolt 29 is threaded and threads into a square nut positioned within the inner leg 23. The square nut is of a size that it freely slides with the inner leg 23 but cannot rotate and allows the adjustment bolt 29 to be tightened from one side.

Figure 3:
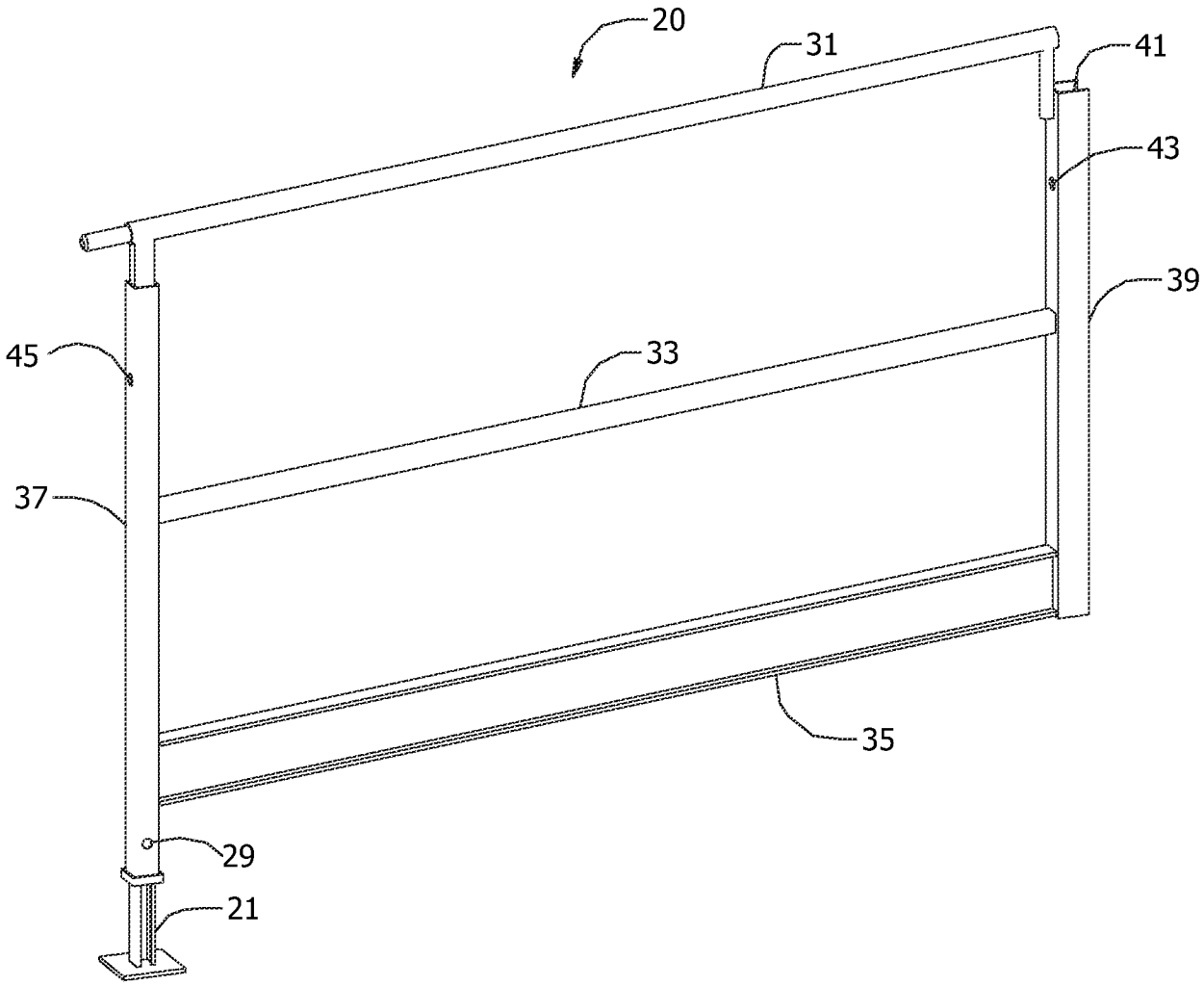
FIG. 3 is a perspective view of a complete example of a railing section.

In FIG. 3 a full railing section 20 is shown which would ideally be shipped as one piece to facilitate assembly onsite. The railing section 20 has a handrail and/or guardrail 31, a mid-rail 33, and a foot rail 35 running longitudinally and an inner post 37 on the first end and an outer post 39 on the second end. The outer post 39 is preferably a square C-channel with an outer newel channel 41 configured to receive a inner post 37 within it. The outer post 39 also has an outer newel aperture 43 that aligns with an inner newel aperture 45 of an adjacent railing section 20 and allows a bolt to pass therethrough and connect to a square nut within an adjacent inner post 37.

Figure 4:
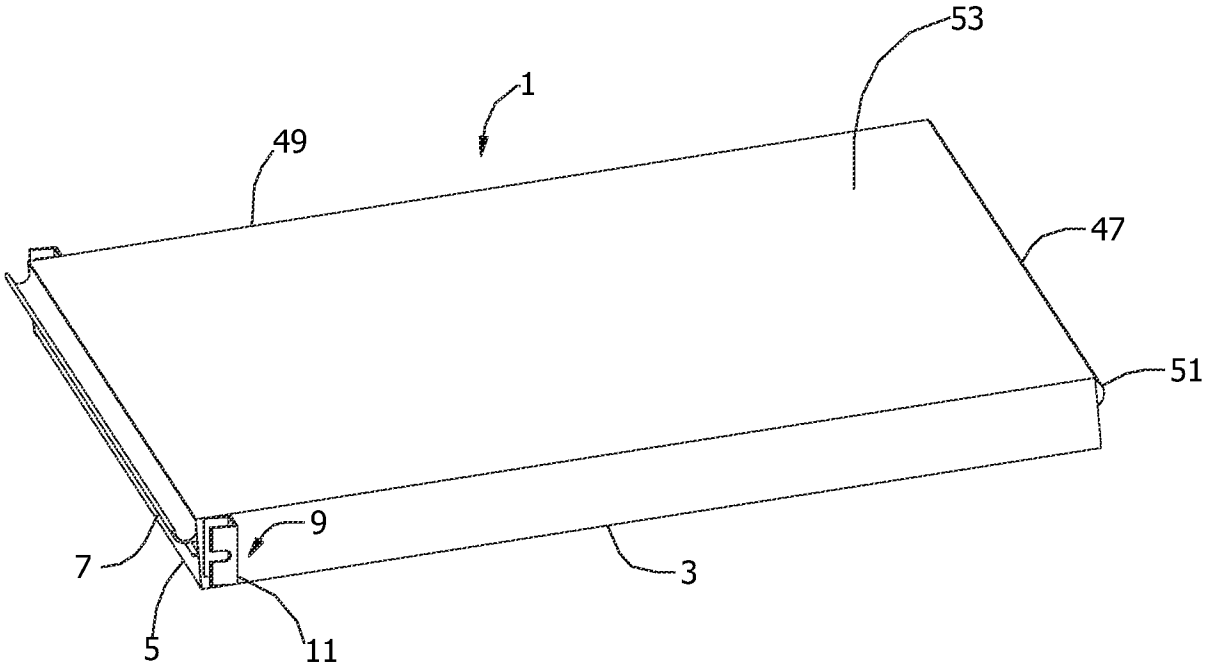
FIG. 4 is a perspective view of a complete example of a ramp section.

FIG. 4 depicts a full ramp section 1 showing the first and second transverse sidewall 5, 47 and the first and second longitudinal sidewall 3, 49. The first transverse sidewall 5 is coupled to the male J-hook 7 connector while the second transverse sidewall 47 is coupled to a female J-hook connector 51 which allows ramp sections to be connected end to end. Across the top of the ramp section 1 is a deck 53 made from decking material, typically extruded aluminum with a non-slip surface texture.

Figure 5:
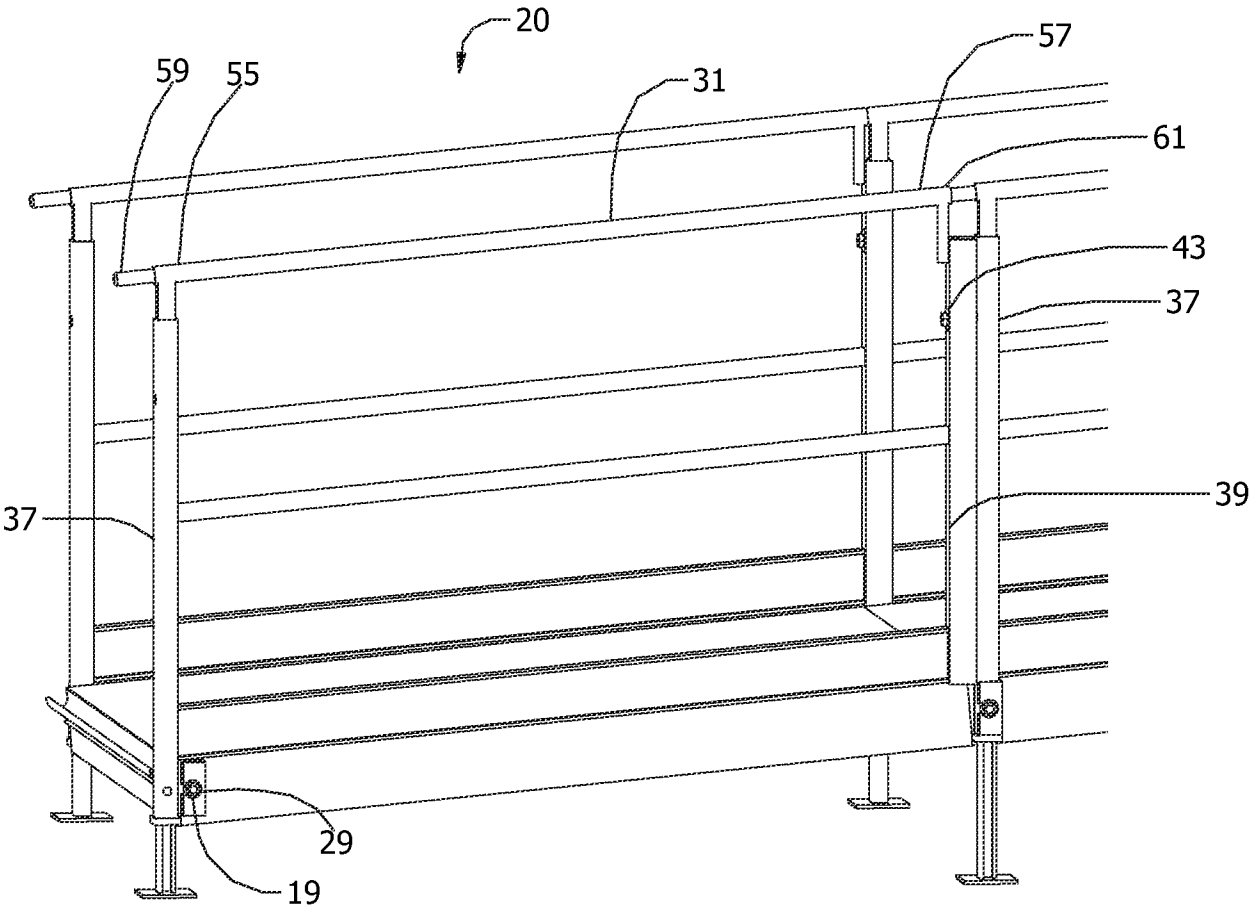
FIG. 5 is a perspective view of a ramp section and railing section assembled, and attached to an adjacent ramp section.

FIG. 5 is an assembly of the ramp sections 1 and railing sections 20 that depicts a railing section just prior to being assembled. The railing section 20 comprises a guardrail/handrail 31 with railing section first end 55 and a railing section second end 57. The railing section first end 55 necks down to a small tube 59 that will fit tightly into the large tube 61 on the railing section second end 57. As railing section 20 is slid into place the small tube 59 slides into the large tube 61 and the outer post 39 slides over the inner post 37 and the adjustment bolt 29 slides into the attachment channel 19. The railing section is held in place by a bolt through the outer newel aperture 43.

Figure 6:
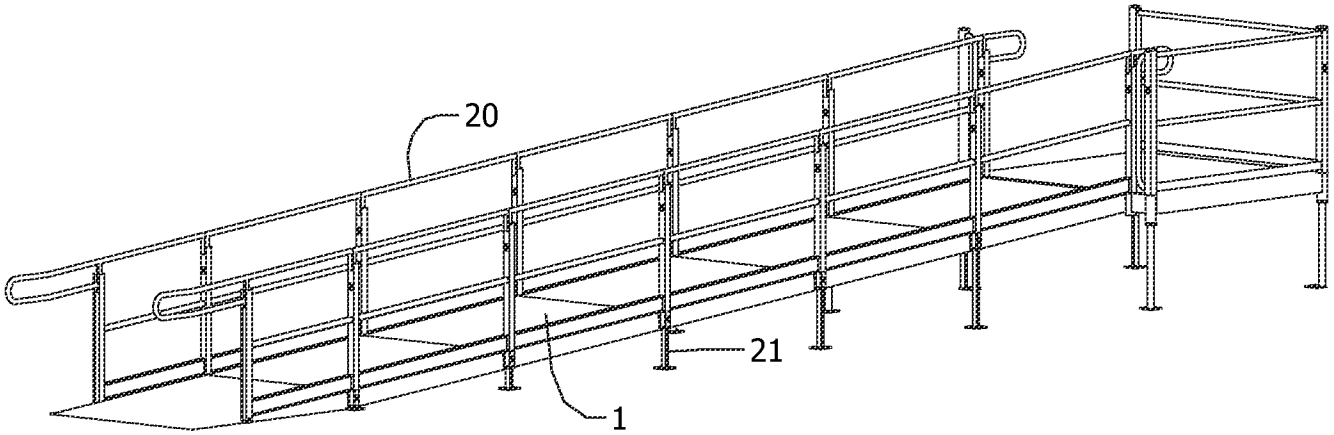
FIG. 6 is a perspective view of a plurality of ramp sections and a plurality of railing sections assembled.
Figure 7:
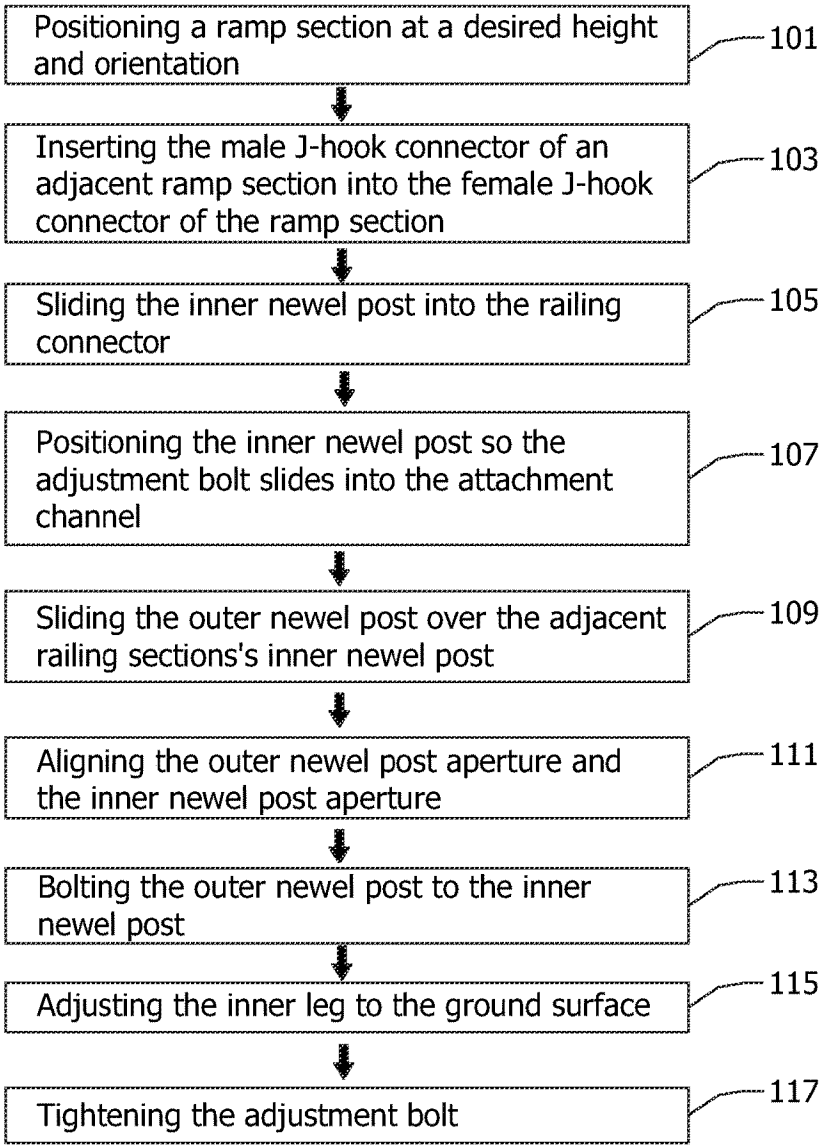
FIG. 7 is a flow diagram for assembly of a wheelchair ramp.

FIG. 6 is an example of a full handicap ramp section from a landing to the exit ramp on the ground surface. The handicap ramp is made for a plurality of railing sections 20 and ramp sections 1. Which are each shipped and sold as a single piece that can be assembled on site. The only adjustment required on site is the adjustable leg must be adjusted to the ground surface to maintain the desired ramp angle.

The method of assembling the wheelchair ramp is first accomplished by positioning a ramp section at a desired height and orientation 101. Inserting the male J-hook connector of an adjacent ramp section into the female J-hook connector of the ramp section 103. Sliding the inner post into the railing connector 105. Positioning the inner post so the adjustment bolt slides into the attachment channel in railing connector 107. Sliding the outer post over the adjacent railing section's inner post while simultaneously sliding the large tube 61 over the adjacent railing's small tube 59 109. The outer post has a channel 41 that is slightly larger than the inner post and makes a tight fit. Aligning the outer post aperture and the inner post aperture 111. Then bolting the outer post to the inner post 113 by tightening the bolt into a square nut that fits inside the inner post. Adjusting the inner leg to the ground surface or to a pad or pier block 115. Tightening the adjustment bolt 117 which keeps the inner leg from sliding and keeps the railing section from exiting the attachment channel.

I claim:

1. A modular ramp comprising, a plurality of ramp sections connected end to end, the plurality of ramp sections each having a first longitudinal sidewall running along its length, a railing connector coupled to the first longitudinal sidewall, the railing connector having an attachment channel cut into an outside flange, a plurality of railing sections comprising, an inner post, an adjustable leg and, an adjustment bolt and, an outer post having an outer newel channel wherein, the plurality of ramp sections are connected to the plurality of railing sections at the railing connectors wherein, the railing connectors comprise, a square C-channel having an open end facing away from the ramp section.

2. The modular ramp of claim 1 wherein, the railing connectors are oriented vertically.

3. The modular ramp of claim 1 wherein, the attachment channel is horizontal.

4. The modular ramp of claim 1 further comprising, a first transverse sidewall having a male J-hook configured to connect to a female J-hook of another ramp section.

5. The modular ramp of claim 1 wherein, the adjustable leg comprises, a fixed portion and an inner leg that slidably fits within the fixed portion, a foot affixed to the end of the inner leg, a channel configured to allow the inner leg to slide past an adjustment bolt.

6. The modular ramp of claim 5 wherein, the adjustment bolt clamps the inner leg in place relative to the fixed portion and, connects the railing section and ramp sections together.

7. The modular ramp of claim 1 wherein, the railing section is one piece comprising, a handrail, a mid-rail and, a foot rail running longitudinally between the inner post and the outer post.

8. The modular ramp of claim 1 wherein, the outer post is a square C-channel configured to receive an inner post within it.

9. The modular ramp of claim 8 further comprising, an outer newel aperture in the outer post and, an inner newel aperture in the inner post wherein, the outer newel aperture is configured to align with an inner newel aperture of an adjacent railing section and, the inner newel aperture is configured to align with an outer newel aperture of an adjacent railing section.

10. A modular ramp section comprising, a ramp section, the ramp section having a first longitudinal sidewall running along its length, a railing connector coupled to the first longitudinal sidewall, the railing connector having an attachment channel cut into an outside flange, a railing section comprising, an inner post having an adjustable leg and an adjustment bolt, an outer post having an outer newel channel wherein, the ramp section is connected to the railing section at the railing connector wherein, the railing connector comprises, a square C-channel having an open end facing away from the ramp section, the railing connector is oriented vertically and, the attachment channel is horizontal.

11. The modular ramp section of claim 10 wherein, the adjustable leg comprises, a fixed portion and an inner leg that slidably fits within the fixed portion, a foot affixed to an end of the inner leg, a channel configured to allow the inner leg to slide past the adjustment bolt.

12. The modular ramp section of claim 11 wherein, the adjustment bolt clamps the inner leg in place relative to the fixed portion and, connects the railing section and ramp sections together.

13. The modular ramp section of claim 10 wherein,
the railing section is one piece comprising,
a handrail,
a mid-rail and,
a foot rail running longitudinally between the inner post and the outer post.

14. The modular ramp section of claim 13 further comprising,
an outer newel aperture in the outer post and,
an inner newel aperture in the inner post wherein,
the outer newel aperture is configured to align with an inner newel aperture of an adjacent railing section and,
the inner newel aperture is configured to align with an outer newel aperture of an adjacent railing section.

15. A method of assembling modular ramp comprising the steps of,
positioning a ramp section at a desired height and orientation,
inserting a male J-hook connector of an adjacent ramp section into a female J-hook connector of the ramp section,
sliding an inner post of a railing section into a railing connector,
positioning the inner post such that an adjustment bolt slides into an attachment channel in a railing connector,
sliding an outer post over an adjacent railing section's inner post
wherein,
an outer post has a channel that is slightly larger than the inner post and is configured to fit over the inner post, and
a large tube at a second end of the railing section is slightly larger than a small tube on a first end of the railing section and is configured to fit over the small tube.

16. The method of claim 15 further comprising the steps of,
aligning an outer post aperture and an inner post aperture and,
bolting the outer post to the inner post by tightening a bolt extending through the outer and inner post apertures and into a nut that fits inside the inner post.

17. The method of claim 15 further comprising the steps of,
adjusting an inner leg to a ground surface and,
tightening the adjustment bolt which is configured to:
keep the inner leg from sliding within the inner post and,
keep the railing section from exiting an attachment channel.

* * * * *